US006864029B2

(12) United States Patent
Hamano et al.

(10) Patent No.: US 6,864,029 B2
(45) Date of Patent: Mar. 8, 2005

(54) ELECTROPHOTOGRAPHIC TONER, MANUFACTURE OF THE SAME, ELECTROSTATIC LATENT IMAGE DEVELOPER, AND IMAGE FORMING METHOD

(75) Inventors: Hirokazu Hamano, Minamiashigara (JP); Manabu Serizawa, Minamiashigara (JP); Katsumi Daimon, Minamiashigara (JP); Yuka Ishihara, Minamiashigara (JP); Norihito Fukushima, Minamiashigara (JP); Takashi Imai, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 74 days.

(21) Appl. No.: 10/307,313

(22) Filed: Dec. 2, 2002

(65) Prior Publication Data

US 2003/0104296 A1 Jun. 5, 2003

(30) Foreign Application Priority Data

Dec. 4, 2001 (JP) ..... 2001-369598

(51) Int. Cl.[7] ..... G03G 15/20

(52) U.S. Cl. ..... 430/107.1; 430/109.1; 430/109.4; 430/111.4

(58) Field of Search ..... 430/107.1, 109.1, 430/109.4, 111.4

(56) References Cited

U.S. PATENT DOCUMENTS 6,607,864 B2 * 8/2003 Serizawa et al. ..... 430/109.1

FOREIGN PATENT DOCUMENTS

| | | |
|---|---|---|
| JP | B2 56-13943 | 4/1981 |
| JP | B2 62-39428 | 8/1987 |
| JP | B2 63-25335 | 5/1988 |
| JP | A 4-120554 | 4/1992 |
| JP | B2 4-30014 | 5/1992 |
| JP | A 4-239021 | 8/1992 |
| JP | A 5-165252 | 7/1993 |

* cited by examiner

*Primary Examiner*—Mark A. Chapman
(74) *Attorney, Agent, or Firm*—Oliff & Berridge, PLC

(57) ABSTRACT

The present invention uses a crystalline resin as a binding resin and provides a toner insuring excellent storability of a resulting image, a method of manufacturing the toner, an electrostatically charged image developer containing the toner, and an image forming method. In the electrophotographic toner containing toner mother particles comprising at least a binding resin and a colorant, a main component of said binding resin comprises a crystalline resin with a melting point in the range from 50 to 120° C. and an average volume particle size in the range from 3.0 to 7.5 $\mu$m, while an average value of the BET specific areas of said toner mother particles is in the range from 0.6 to 3.0 $m^2/g$. The electrophotographic toner manufacturing method comprises the steps of coalescing or associating the binding resin particles with colorant particles, and cooling the aggregated particles at the rate of at least 1° C. per minute or more to a temperature below the crystallizing temperature of the binding resin to generate toner particles.

14 Claims, 1 Drawing Sheet

ELECTROPHOTOGRAPHIC TONER, MANUFACTURE OF THE SAME, ELECTROSTATIC LATENT IMAGE DEVELOPER, AND IMAGE FORMING METHOD

BACKGROUND OF THE INVENTION

1. Field of Invention

The present invention relates to a toner which can be used in an electrophotographic apparatus such as a copier, printer, or facsimile machine, to a method of manufacturing the same, and to an image forming method making use of a toner for electrophotography.

2. Description of Related Art

Conventional systems for fixing a toner for electrophotography include the pressure fixing system in which a pressurizing roller is employed at room temperature, a contact heating fixing system in which a heating roller or the like is used, an oven fixing system involving heating in an oven, a flush fixing system using a xenon lamp of the like, an electromagnetic fixing system making use of microwaves or the like, and a non-contact fixing system such as a solvent fixing system using a solvent steam. Among these, the most commonly employed today are the oven fixing system and the contact heat fixing system because their reliability and safety are relatively high. Especially, the contact heating type of fixing system using a heating roller, a belt, or the like generally comprises a heating roller or a belt with a heat source provided thereon and a pressurizing roller or a belt, and fixing is performed by passing a fixed sheet with a toner image thereon over the heating roller or the belt in a state wherein the surface of the fixed sheet with the toner image thereon is pressed and contacted to the heating roller or the belt. Because the surface of the heating roller or a belt surface directly contacts the toner imager surface of the fixed sheet, the heat efficiency is high and fixing can be performed quickly, making this system especially popular.

In the thermal fixing system, shortening of the time from the time from when a power is turned ON until the temperature of a fixing device rises to a level at which the fixing device can be used for fixing a toner image, in other words shortening of the warm-up time, and fixing under low temperature in order to reduce the energy consumption rate are both desired. In recent devices it is a requirement that, in order to save energy, supply of power to the fixing machine be stopped when the fixing machine is not being used, and therefore a temperature of the fixing device should preferably rise to the fixing temperature immediately after power supply is started, so that the fixing operation should be performed at as low a temperature as possible. By lowering the fixing temperature to the extent possible, it becomes possible to realize a faster printing speed while maintaining the same power consumption rate, and further to prolong the service lifetime of components for fixing such as a heating roller required for the contact heating type of fixing system, which is advantageous also for cost reduction. In the conventional technology, however, when the temperature required for fixing a toner image is lowered, also the glass transition temperature of the toner particles is lowered, which makes it difficult to stably store the toner for a long time. To simultaneously ensure compatibility with low temperature fixing of a toner image at a low temperature and long term, stable storability of the toner, it is necessary to develop a toner having what is known as a "sharp" melting capability, in other words, a toner which has a high glass transition temperature and viscosity of which quickly drops in the high temperature range.

Generally, however, non-crystalline resins are used for production of toners. Because the glass temperature point and molecular weight of such resins vary over a wide range, it is necessary to control the composition and molecular weight of a resin used for production of a toner within extremely narrow ranges for realization of the sharp melting capability. To obtain a resin satisfying the requirements noted above, it is necessary to employ a specific production method and to carefully control the molecular weight of a resin used for production of a toner by processing the resin by means of, for example, chromatography. As a result, the production cost of the resin is higher and unnecessary resins are produced, which is undesirable from the viewpoint of environment protection.

To provide a toner adapted to fixing at a low temperature as described above, the possibilities provided by the method in which a crystalline resin is used as a binding resin have been discussed (Refer to, for instance, Japanese Patent Publication No. SHO 56-13943, Japanese Patent Publication No. SHO 62-39428, Japanese Patent Publication No. SHO 63-25335). In this method, by using a crystalline resin, hardness of the toner is maintained at a temperature lower than the melting point of the crystal, and when the temperature exceeds the melting point the viscosity quickly drops in association of melting of the crystal. Thus, the adaptability to being fixed under a low temperature is realized. However, in the technology disclosed in the above documents, for example, in Japanese Patent Publication No. SHO 56-13943, the melting point of the crystalline resin is in the range from 62 to 66° C., and its melting point is too low, so that the reliability of toner powder and images developed with the toner is rather low. There is a further disadvantageous problem in that the crystalline resin disclosed in Japanese Patent Publication No. SHO 62-39428 and Japanese Patent Publication No. SHO 63-25335 is not sufficiently adapted to being fixed to paper.

Polyester resin is one of the crystalline resins, which may have improved adaptability to being fixed to paper. An example of a toner based on the crystalline polyester resin is disclosed in, for example, Japanese Patent Publication No. SHO 62-39428. This patent publication proposes a method in which non-crystalline polyester having a glass transition temperature of more than 40° C. and crystalline polyester having a melting point in the range from 130 to 200° C. are mixed together in use. Although this method provides resins with excellent adaptability to being powdered and also having the excellent capability for preventing blocking, the crystalline polyester resins provided by this method generally have a high melting point, so that fixing of a toner image can not be performed at a temperature lower than that in the prior art. There is also an example in which a crystalline resin having the melting point of less than 110° C. and a non-crystalline resin are mixed to prepare a toner (as disclosed in, for example, Japanese Patent Publication No. HEI 4-30014). In a case wherein a non-crystalline resin is mixed in a crystalline resin, the melting point of the toner becomes lower, which causes several disadvantageous problems in actual use such as blocking of the toner and poor storability of images developed with the toner. When a content of the non-crystalline resin component is larger, the characteristics of the non-crystalline resin are substantially reflected to the prepared toner, so that it is difficult to perform fixing at a temperature lower than that in the conventional technology. In actual practice, therefore, a single crystalline resin must be used for preparation of a toner or to mix only an extremely small quantity of non-crystalline resin in a crystalline resin for preparation of a toner.

As described above, it is desirable to use, to the extent possible, a single crystalline polyester resin for fixing a toner image with a heating roller. Examples of using a crystalline polyester resin are disclosed in, for example, Japanese Patent Laid-Open Publication No. HEI 4-120554, Japanese Patent Laid-Open Publication No. HEI 4-239021, and Japanese Patent Laid-Open Publication No. HEI 5-165252. However, there are resins in which alkylene alcohol having a small number of carbon atoms or aliphatic alcohol is reacted with carboxyl groups of a telephthalic acid. These patent publications include descriptions concerning crystalline polyester resins, but the described crystalline polyester resins are only partially crystallized, and the viscosity of the toners prepared with those resins does not vary in connection with changes in temperature. Although resistance against blocking and the storability of images developed with such toners are excellent, but fixing with a heating roller cannot be performed at a temperature lower than that in the prior art.

On the other hand, toner particles manufactured by conventional kneading and pulverizing methods generally have heterogeneous shapes and heterogeneous compositions. Although shape and surface composition of toner particles does slightly change according to their adaptability to pulverization, type of pulverizer, and conditions for pulverization, these parameters are not easily controlled in order to produce particles within a desired range. Recently there is also a tendency to produce toners with smaller particle size in order to improve the image quality developed with the toners, but when toner particles are produced with materials adapted to be pulverized for producing toners with smaller particle size, the toner particles may further be pulverized due to a mechanical force such as a shearing force within a developing unit, which may in turn change the form of the toner particles. As a result, for a developer comprising two components, namely toner particles and a carrier, adaptability of the developer to being electrically charged may be degraded quickly due to deposition of the fine particles to a surface of the carrier, and, in a case of a developer comprising one component, namely comprising only toner particles, the toner may easily be scattered due to widening of a range of particle size distribution, or the adaptability to development may be degraded due to change in forms of the toner particles, which may in turn degrade quality of images developed with the toners. As such, there have been technological restrictions in reducing the toner particle size.

Further in a case of preparing a toner by adding a large quantity of a release agent such as a wax in a resin according to the conventional type of kneading and pulverizing method, because the release agent is more fragile than the resin, the release agent may often come out of a surface of the toner particle. It is advantageous to improve the release property during fixing and to clean off a toner transferred from a photoreceptor, but as the release agent on a surface of the toner particle easily transfers to and contaminates such components as a development roller, a photosensitive roller, and a carrier, reliability is lowered.

Further, when forms of the toner particles are not heterogeneous, the fluidity is not sufficient even if a fluidizing agent is added, and further fine particles of the fluidizing agent remove to concave sections of the toner particles and are buried therein, so that the fluidity lowers as use continues, and sometimes the adaptability of the toner to being developed, transferred, and cleaned may be disadvantageously lowered. When the toner particles are heterogeneous, especially the adaptability to being transferred is further degraded because the adhesiveness increases due to such reasons as increase of contact points. If a larger quantity of fluidizing agent is added to prevent the problems as described above, black points may be generated on the photoreceptor, and in a case of the two-component developer, the fluidizing agent is deposited on the carrier, which disadvantageously degrades the adaptability to being electrically charged.

The present invention was made in light of the circumstances described above in order to solve the above problems.

More specifically, it is an object of the present invention to enable fixing at a lower temperature as compared to that in the prior art, substantial reduction of energy consumption in the fixing step, and shortening of the warm-up time by using a crystalline polyester resin having the low melting point as a main component of a binding resin. It is another object of the present invention to provide the excellent storability of images after fixing.

It is still another object of the present invention to provide a toner for electrophotography with superior adaptability and which is transferred by mixing at least a binding resin particle dispersion liquid with a colorant particle dispersion liquid and adding a coagulant in the mixture to prepare toner particles with spherical form.

SUMMARY OF THE INVENTION

The problems are solved by the means as described below. The examples described in <2> to <5>, <9>, and <10> are subsequently described in more detail as preferred embodiments of the present invention.

<1> An electrophotographic toner comprising toner mother particles consisting primarily of at least a binding resin and a colorant, wherein the binding resin comprises a crystalline resin having the melting temperature in the range from 50 to 120° C. as a main ingredient, the average volume particle size of the toner mother particles is in the range from 3.0 to 7.5 $\mu$m, and the BET specific surface area of the toner mother particles is in the range from 0.6 to 3.0 $m^2/g$.

<2> An electrophotographic toner wherein the crystalline resin is a crystalline polyester resin.

<3> An electrophotographic toner as described in <1>, in which the crystalline polyester resin is an aliphatic crystalline polyester resin.

<4> An electrophotographic toner as described in <3>, in which said crystalline polyester resin contains a dicarboxylic acid having a sulfonic acid group or a diol as a copolymer component.

<5> An electrophotographic toner in which an average value of shape factors (SF1) for said toner particles is in the range from 110 to 140.

<6> A method of manufacturing an electrophotographic toner comprising an aggregating process of mixing at least a binding resin particle dispersion liquid and a colorant dispersion liquid for aggregating the binding resin particles and colorant particles, a coalescing process of coalescing the aggregated particles after aggregation at a temperature higher than the melting point of the binding resin particles, and a cooling process of cooling the aggregated and coalesced particles after coalescing at a rate of 1° C. per minute down to the crystallization temperature of the binding resin or below to generate toner particles.

<7> A method of manufacturing an electrophotographic toner comprising an associating process of mixing at least a binding resin particle dispersion liquid and a colorant dispersion liquid, heating the mixture to a temperature equal to or higher than the melting point of the binding resin as a main component of the binding resin particle, and adding a coagulant in the mixture to associate the binding resin particles with the colorant particles, and a cooling process of cooling the mixture, after the association, at a rate of 1° C. per minute, down to the crystallization temperature of the binding resin to generate the toner particles.

<8> An electrostatic latent image developer which is an electrophotographic toner comprising toner particles and a carrier, in which the toner particles are those of the electrophotographic toner described in any one of <1> to <5> above.

<9> An image forming method comprising a developing stage of developing an electrostatic latent image formed on an electrostatic latent image carrier with a developer comprising the toner described in <1> to form a toner image, a transfer state of transferring the toner image formed on the electrostatic latent image carrier to a transfer material to form a transfer image, and a fixing state of fixing the transfer image transferred onto the transfer material.

<10> A full color toner for electrophotography, in which the electrophotographic toner is capable of forming a toner image comprising three colors of cyan, magenta, and yellow.

<11> An electrophotographic toner, in which the electrophotographic toner contains 0.5 to 40 weight portions of a release agent.

DETAILED DESCRIPTION OF PREFERRED EMBODIMENTS

<Electrophotographic Toner>

Figure 1:
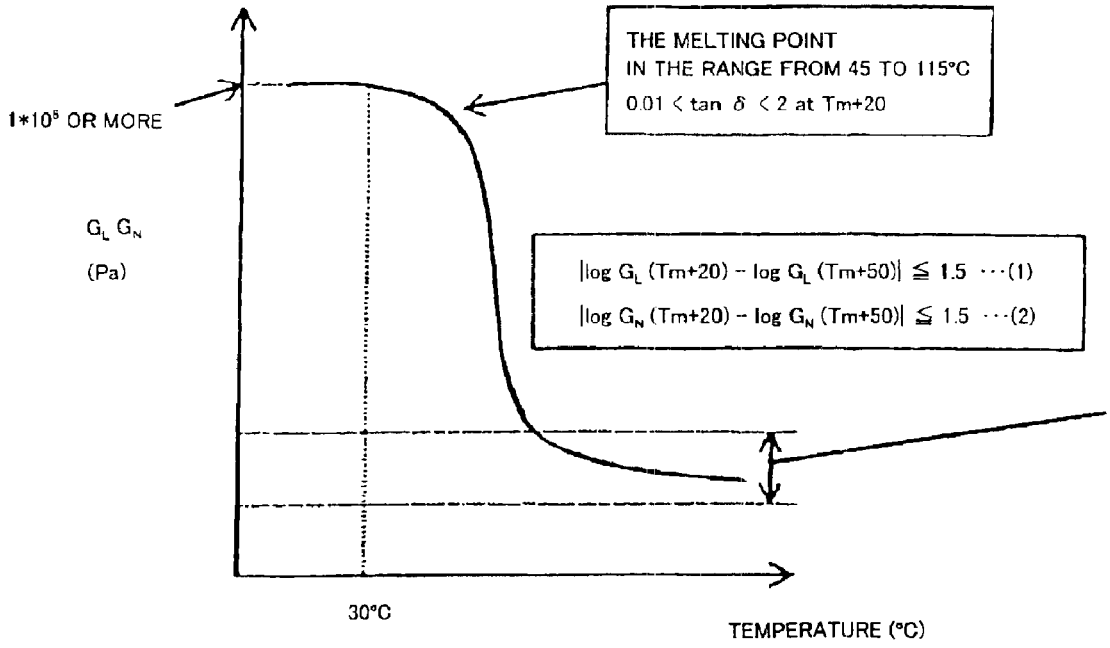
FIG. 1 is a view showing characteristics of a bridged type of crystalline resin used as a binding resin.

The electrophotographic toner used in the present invention (referred to simply as "toner" hereinafter) consists essentially of at least a binding resin as a main component and a colorant, with the binding resin having melting point in the range from 50 to 120° C. As the crystalline resin, crystalline polyester is preferable, with an aliphatic crystalline polyester resin with the melting point in an appropriate range being especially preferable. The binding resin is described below with reference to a crystalline polyester as an example.

(Binding Resin)

The crystalline polyester resin is synthesized from an acid (dicarboxylic acid)-derived component and an alcohol (diol)-derived component, and as used herein, the term of "acid-derived component" refers to a composition element which was a component of the acid before the polyester resin was synthesized, while the term of "alcohol-derived component" refers to a composition element which was a component of the alcohol before the polyester resin was synthesized.

When the polyester resin is not a crystalline resin, in other words, when the polyester resin is a non-crystalline resin, although it is possible to ensure excellent low temperature fixing properties, it is impossible to ensure the anti-blocking property of the toner or storability of images developed with the toner. Therefore, as used herein, the term of "crystalline polyester resin" indicates a resin showing not a step-like change in the endothermic rate, but a clear endothermic peak in the differential scanning calorie (DSC) measurement. Further, in a case of a polymer in which other component is copolymerized in a main chain of the crystalline polyester, if a content of the other component is less than 50 weight % the copolymer is referred to as crystalline polyester.

Acid-Derived Component

The acid-derived component is preferably a aliphatic dicarboxylic acid, and more preferably a straight chain type carboxylic acid. The acid-derived component may be, but is not limited to, oxalic acid, maleic acid, succinic acid, gultaric acid, adipic acid, pimelic acid, pimelic acid, suberic acid, azelic acid, sebacic acid, 1,9-nonan dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradecane dicarboxylic acid, 1,16-hexadecane dicarboxylic acid, 1,18-octadecane dicarboxylic acid, and a lower alcohol or a acid anhydrate thereof.

The acid-derived component should preferably contain, in addition to the component derived from the aliphatic dicarboxylic acid described above, a component from a dicarboxylic acid having a double bond, a component from a dicarboxylic acid having a sulfonic acid group, or the like.

The component from the dicarboxylic acid having a double bond may also be a component from a lower alkyl ester or a hydrate of the dicarboxylic acid having a double bond. Further the component from the dicarboxylic acid having a sulfonic acid group may also be a component from a lower alkyl ester or an anhydrate thereof.

The dicarboxylic acid having a double bond can advantageously be used for preventing hot offset during fixing, because it can bridge the entire resin making use of the double bond. The dicarboxylic acid as described above includes, but is not limited to, for example, fumaric acid, maleic acid, 3-hexene dioic acid, and 3-octane dioic acid. Lower alkyl esters and acid anhydrates thereof may be used for the same purpose.

A dicarboxylic acid having a sulfonic acid group is advantageous because it can efficiently disperse a color material such as pigment. Further, when a sulfonic acid group is available the resin as a whole can easily be emulsified or suspended in water to convert the toner mother particles to fine particles as described above. The dicarboxylic acid having a sulfonic acid group as described above includes, but is not limited to, for example, sodium 2-sulfotelephthalate, sodium 5sulfoisophtalate, and sodium sulfosuccinate. Further, lower alkyl esters and acid anhydrates thereof may be used for the same purpose. Of these, the sodium 5sulfoisophthalate is the most preferable from the viewpoint of cost.

A content of a component from any acid other than the aliphatic dicarboxylic acid (component from dicarboxylic acid having a double bond and/or component from dicarboxylic acid having a sulfonic acid group) should preferably be in the range from 1 to 20 composition molar %, or more preferably in the range from 2 to 10 composition molar %.

When the content is less than 1 composition molar %, there may occur problems such that the pigment is not sufficiently dispersed, and that size of the emulsified particles becomes larger, which makes it difficult to adjust the toner particle size by means of aggregation. On the other hand, when the content is over 20 composition molar %, crystalloid of the polyester resin is degraded and the melting point lowered, which in turn degrades storability of images developed with the toner, or size of emulsified particles is too small and is dissolved in water, which may inhibit generation of latex.

It should be noted that, as used herein, the term "composition molar %" is used to refer to a percentage assuming that a content of each component in the polyester resin (acid-derived acid, or alcohol-derived component) is 1 unit (mole).

Alcohol-Derived Component

Aliphatic dicarboxylic acid is preferable as the alcohol-derived component, and includes, but is not limited to, for example, ethylene glycol, 1,3-propane diol, 1,4-butane diol, 1,5-pentane diol, 1,6-hexane diol, 1,7-heptane diol, 1,8-octane diol, 1,9-nonane diol, 1,10-decane diol, 1,11-dodecane diol, 1,12-undecane diol, 1,13-tridecane diol, 1,14-tetradecane diol, 1;18-octadecane diol, and 1,20-eicosane diol.

When the alcohol-derived component is that from aliphatic diol, a content of the aliphatic diol-derived component is more than 80 composition %, and other components may be included according to the necessity. Further when the alcohol-derived component is that from aliphatic diol, a content of the aliphatic diol-derived component should preferably be more than 90 composition %.

When a content of the component from aliphatic diol is less than 80 composition molar %, crystalloid of the polyester resin is degraded with the melting point lowering, so that the capability of preventing toner blocking, storability of images developed with the toner, and the adaptability to being fixed under a low temperature are degraded.

Other components which may be contained according to the necessity includes a component derived from diol having a double bond and that derived from a diol having a sulfonic acid group.

The diol having a double bond includes, for instance, 2-butene-1,4-diol, 3-butene-1,6-diol, and 4-butene-1,8-diol.

The diol having a sulfonic acid group includes, for instance, 1,4-dihydroxy-2-benzensulfonic acid sodium salt, sodium 1,3-dihydroxymethyl-5-benzenesulfonic acid, and 2-sulfo-1,4-butane diol sodium salt.

When any of these alcohol-derived components other than those from the straight-chain type of aliphatic diol as described above is added, namely when a component derived from diol having a double bond and/or that from diol having a sulfonic acid group is added, a contact of the component derived from having diol having a double bond or a sulfonic acid group in the all alcohol-derived components should preferably be in the range from 1 to 20 composition molar %, and more preferably in the range from 2 to 10 composition molar %.

When a content of an alcohol-derived component other than that from the aliphatic diol in the all alcohol-derived components is less than 1 composition molar %, the pigment may not be dispersed sufficiently with the particle size becoming larger when emulsified, and it may not be possible to further adjust toner particle size by means of aggregation. On the other hand, when the content is over 20 composition molar %, crystalloid of polyester resin is degraded with the melting point lowering, and storability of images developed with the toner is degraded, or the particle size may be too small when emulsified and the particles may be dissolved in water to inhibit generation of latex.

The melting point of the binding resin according to the present invention is in the range from 50 to 120° C., and is more preferably in the range from 60 to 110° C. When the melting point is less than 50° C., storability of the toner and storability of toner images after fixed may be degraded. On the other hand, when the melting point is more than 120° C., the adaptability of the toner to being fixed at a lower temperature is lower as compared to that with the conventional type of toners.

In the present invention, a differential scanning calorimeter (DSC) is used for measurement of the melting point of crystalline resins, and the melting point is obtained as a melting peak temperature in the input compensation differential scanning calorie measurement as defined in JIS K-7121 when the measurement is performed at the programming rate of 10° C. per minute from the room temperature to 150° C. Although some types of crystalline resins may show a plurality of melting peak, the highest melting peak temperature is regarded as the melting point in the present invention.

The method of manufacturing the polyester resin is not specifically restricted in conjunction with the present invention, and the polyester resin may be manufactured by a typical polyester polymerizing method in which an acid component and an alcohol component are reacted to each other or, for example, any other appropriate method such as direct polycondensation or transesterification according to type of a monomer. A molar ratio of an acid component/an alcohol component in the reaction in which an acid component is reacted to an alcohol component varies according to conditions for the reaction, but generally the ratio is generally about 1:1.

The polyester resin can be manufactured under a temperature for polymerization in the range from 180 to 230° C., a space provided reaction system is depressurized as necessary, and the reaction is performed removing the water and alcohol generated during the polycondensing process.

When the monomer is not dissolved or made phase-soluble under the reaction temperature, a solvent with a high boiling point may be added to the reaction system as a co-adjuvant for dissolving the monomer. The polycondensation reaction is performed removing the co-adjuvant by distillation. When a monomer having low phase-solubility is present in the polycondensation reaction, the monomer should preferably be condensated with an acid or an alcohol with which the monomer is polymerized, and then should be subjected to the polycondensation reaction with the main component.

Catalysts which can be used for manufacturing the polyester resin, include, but are not limited to, compounds of alkali metals such as sodium and lithium; those of alkali-earth metals such as magnesium and potassium; those of metals such as zinc, manganese, antimony, titanium, tin, zirconium, and germanium; phosphorous compounds; phosphate compounds; and amine compounds; and more specifically, the catalysts include sodium acetate, sodium carbonate, lithium acetate, potassium carbonate, calcium acetate, calcium stearate, magnesium acetate, zinc acetate, zinc stearate, zinc naphthenate, zinc chloride, manganese acetate, manganese naphthenate, titanium naphthenate, titanium tetrapropoxide, titanium tetraisopropoxide, titanium tetrabutoxide, antimony trioxide, triphenyl antimony, tributyl antimony, tin formate, tin oxalate, tetraphenyl tin, dibutyl tin dichloride, dibutyl tin oxide, diphenyl tin oxide, zirconium tetrabutoxide, zirconium naphtenate, zirconyl carbonate, zilconyl acetate, zirconyl stearate, zirconyl octylate, germanium oxide, triphenyl phosphite, tris (2,4-di-t-butylphenyl) phosphite, ethyltriphenyl phosphonium bromide, triethyl amine, and triphenyl amide.

(Colorant)

For colorants this invention may employ dyes or pigments, although pigments are preferable. Acceptable pigments include, but are not limited to, for example, carbon block, aniline block, aniline blue, carco-oil blue, chrome yellow, ultramarine blue, Dupont oil red, quinolline yellow, methylene blue chloride, phtalocyannine blue, malachite green oxalate, lamp block, rose Bengal, quinacridone, benzidine yellow, the pigment listed in the Color Index as C.I. Pigment Red 48:1, C.I. Pigment Red 57:1, C.I. Pigment Red 122, C.I. Pigment Red 185, C.I. Pigment Yellow 12, C.I. Pigment Yellow 17, C.I. Pigment Yellow 180, C.I. Pigment Yellow 97, C.I. Pigment Yellow 74, C.I. Pigment Blue 15:1, C.I. Pigment Blue 15:3, and the like. Magnetic particles may also be used as colorants in the present invention. Example magnetic particles include known magnetic bodies including strong magnetic metals such as cobalt, iron, nickel and the like; metal alloys containing cobalt, iron, nickel, aluminum, lead, magnesium, zinc, manganese and the like; metal oxides in which the metal is selected from cobalt, iron, nickel, aluminum, lead, magnesium, zinc, manganese and the like. Other acceptable pigments include chrome yellow, hanza yellow, or the like.

Any pigment may be used by itself or in combinations of two or more pigments or pigment types.

The content of the colorant in the toner for electrophotography should preferably be in the range from 0.1 to 40 weight portions and more preferably in the range from 1 to 30 weight portions assuming a weight of the resin as 100.

It should be noted that toners having various colors such as yellow, magenta, cyan, and black can be obtained by appropriately selecting among colorants as described above.

(Other Components)

There is no specific restriction over the other components, and any material may be selected according to desired purpose. For example, known additives such as inorganic fine particles, charge control agents, and release agents may be included.

Inorganic fine particles may be added to the toner according to the present invention as necessary or desired. Fine particles of such known materials as silica, titanium oxide, alumina, cerium oxide, and those with the surface having been made hydrophobic may be used as the inorganic fine particles singly or in combination, and of these, fine particles of silica having the refraction index smaller than that of the binding resin are preferable because it does not spoil such performances as coloring and OHP transparency. Further the fine particles of silica may be subjected to various types of surface processing, including surface processing with a coupling agent based on silane or titanium, and silicone oil.

Viscosity of the toner can be adjusted by adding inorganic fine particles to control gloss of images and permeation of the toner into paper. The amount of inorganic fine particles in the raw materials should preferably be in the range from 0.5 to 20 weight %, and more preferably in the range from 1 to 15 weight %.

A charge control agent may be added to the toner according to the present invention, if necessary or desired. As the charge control agent, such materials as chrome-based azo colorant, iron-based colorant, aluminum azo colorant, and metal salicylate complex may be used.

The toner according to the present invention should preferably contain a release agent. When the toner contains a release agent, the release property in the fixing process is improved, which makes it possible to reduce a quantity of release oil to be applied on a fixing roller or to eliminate the need of a fixing roller, with a result that troubles such as shortening of the life of the fixing roller or stripes generated by the release oil can be prevented, and also that costs can be reduced.

Specific examples of the release agent include low molecular weight polyolefins such as polyethylene, polypropylene, and polybutene; silicones which melt when heated; fatty acid amides such as oleyl, erucic acid amide, recinoleic acid amide, and stearic acid amide; botanical waxes such as such as carnauba wax, rice wax, Candelila wax, Japan wax, and jojoba oil; animal waxes such as bees wax; and mineral or oil-based waxed such as montan wax, ozokelite, ceresin, paraffin wax, and microcrystalline wax, Fisher-Tropsch wax.

The melting point of the release agent should preferably be in the range from 50 to 120° C., and more preferably be below the melting point of the binding resin. When the melting point of the release agent is less than 50° C., the temperature at which the release agent changes is too low, and in that case the blocking resistance capability is degraded, or the adaptability of the toner to being developed is degraded with a temperature inside the copying machine rises. On the other hand, when the melting point is over 120° C., the temperature at which the release agent changes is too high, and the adaptability of the binding resin to being fixed at a low temperature is spoiled.

One type of release agent may be used singly or two or more release agents may be used in combination.

The content of the release agent in 100 weight portions of toner material should preferably be in the range from 1 to 20 weight portions, and more preferably in the range from 2 to 15 weight portions. When the content is less than 1 weight portion, no effect is achieved by adding the release agent and when the content is more than 20 weight portions, bad effects over the adaptability to being electrically charged often appear and the toner is easily broken within the developing device, such that the release agent or the toner resin is often left on the carrier. This phenomenon not only causes bad effects such as lowering of its adaptability to being electrically charged, but also makes it difficult for a color toner containing the release agent or the toner resin to be fully permeated onto a surface of a fixed image with the release agent easily left on the image, which disadvantageously impairs transparency.

Average Volume Particle Size

The average volume particle size of the electrophotographic toner according to the present invention is in the range from 3.0 to 7.5 $\mu$m, preferably in the range from 3.5 to 6.5 $\mu$m, and more preferably in the range from 3.8 to 6.2 $\mu$m. When the average volume particle size is smaller than 3.0 $\mu$m, its adaptability to being electrically charged is not sufficient, and the charge distribution range becomes wider due to lowering of the fluidity. Because of this phenomenon, sometimes the toner extends to the background area or spills over from the developing unit. When the average volume particle size is larger than 7.5 $\mu$m, the resolution below lower, and the acceptable image quality cannot be obtained.

The average volume particle size can be measured with a particle size analyzing apparatus that uses the Coulter principle, for example, a COULTER COUNTER Model TA-II device (manufactured by Coulter Co., Ltd.), setting the aperture diameter to 50 $\mu$m. The measurement is performed after the toner is dissolved and dispersed with ultrasonic waves for more than 30 seconds in an electrolyte aqueous solution (isoton aqueous solution).

Bet Specific Surface Area

In the electrophotographic toner according to the present invention, an average value of the BET specific surface areas of the toner mother particles should preferably be in the range from 0.6 to 3.0 $m^2/g$, and more preferably in the range from 0.8 to 2.5 $m^2/g$. When the average value of the BET specific surface areas is less than 0.6 $m^2/g$, the toner cannot be manufactured under stable conditions, while, when the average value of the BET specific surface areas is over 3.0 $m^2/g$, troubles occur in that the fluidity and adaptability to transfer are lowered due to loss of stability, and that externally added agents may be deposited or buried on a surface of the particle because of its irregularities.

Measurement of the BET specific surface area is performed by the nitrogen substitution method. More specifically, the measurement is performed with the SA3100 specific surface meter (manufactured by Coulter Co., Ltd.) by the three point method.

Shape Factor

A value of the shape factor SF1 of the electrophotographic toner according to the present invention is in the range from 110 to 140, and more preferably in the range from 112 to 135. When the value is less than 110, the electrophotographic toner cannot be manufacture under stable conditions with the yield lowering and the cost rising. When the value is over 140, the adaptability to transfer is reduced, and the image quality is degraded with the transfer efficiency lowered. As a result, the quantity of residual toner increases, as does cost. Further also the fluidity is degraded.

The shape factor SF1 can be measured by using an image analyzer, as the LUZEX III manufactured by Nireko Corporation. An image of a toner spread over a slide glass sheet taken by an optical microscopy is placed in an image analyzer to obtain SF1 of each of 100 toner particles and average the values. The SF1 is calculated using the following equation:

$$SF1=(\text{Circumferential length of a toner particle})^2/(\text{project area of the toner particle})\times(\pi/4)\times 100 \quad (1)$$

<Preferable Physical Properties of the Electrophotographic Toner According to the Present Invention>

It is desired that the electrophotographic toner according to the present invention have sufficient hardness at room temperature. More specifically, the dynamic viscoelasticity as measured at the angular frequency of 1 rad/sec and at the temperature of 30° C. should preferably satisfy the condition that the storage elastic modulus $G_L$(30) is more than $1\times10^6$ Pa and the loss elastic modulus $G_N$(30) is more than $1\times10^6$ Pa. The storage elastic modulus $G_L$ and the loss elastic modulus $G_N$ are defined in the JIS K-6900 standard.

When the storage elastic modulus $G_L$(30) is less than $1\times10^6$ Pa or the loss elastic modulus $G_N$(30) is less than $1\times10^6$ Pa at the angular frequency of 1 rad/sec and at the temperature of 30° C., when the toner particles are mixed in a carrier in a developing unit, the toner particles deform due to a pressure from the carrier or the shearing force, which makes it difficult to maintain the stable adaptability to being electrically charged and developed. Also when the toner on the electrostatic latent image carrier (or a photoreceptor) is cleaned, the toner particles easily deform due to the shearing force from the cleaning blade, which may in turn cause a cleaning fault.

When the storage elastic modulus $G_L$(30) and loss elastic modulus $G_N$(30) are within the range described above at the angular frequency of 1 rad/sec and at the temperature of 30° C., stability of the toner in fixing is advantageously maintained even when it is used in a high speed electrophotographic apparatus.

It is further preferable that the storage elastic modulus $G_L$(30) and loss elastic modulus $G_N$(30) of the electrophotographic toner according to the present invention change in association with changes in temperature in a ratio of 10 times of more for temperature change of 10° C. (so that values of the storage elastic modulus $G_L$(30) and loss elastic modulus $G_N$(30) become smaller than 1/100 of their original values). If the storage elastic modulus $G_L$(30) and loss elastic modulus $G_N$(30) of the electrophotographic toner according to the present invention do not satisfy the temperature change conditions noted above, the fixing temperature becomes higher and, as a result, the energy consumption rate in the fixing process cannot be reduced.

Further, the electrophotographic toner according to the present invention should preferably satisfy the following equation (2) when a common logarithm of the storage elastic module is plotted against a temperature:

$$|\log G_L(Tm+20)-\log G_L(Tm+50)|\leqq 1.5 \quad (2)$$

wherein $G_L$ (Tm+20) indicates the storage elastic modulus in the temperature range from the melting point Tm to a temperature by 20° C. higher than the melting point, and $G_L$ (Tm+50) indicates the storage elastic modulus in the temperature range from the melting point Tm to a temperature by 50° C. higher than the melting point, or the following equation (3):

$$|\log G_N(Tm+20)-\log G_N(Tm+50)|\leqq 1.5 \quad (3)$$

wherein $G_N$ (Tm+20) indicates the loss elastic modulus in the temperature range from the melting point Tm to a temperature by 20° C. higher than the melting point, and $G_L$ (Tm+50) indicates the loss elastic modulus in the temperature range from the melting point Tm to a temperature by 50° C. higher than the melting point, because, when these conditions are satisfied, heterogeneity of gloss of an image generated due to heterogeneous temperature distribution over the image is reduced.

These indexes indicate that dependency of the viscosity of the electrophotographic toner according to the present invention on temperature is moderate and its dependency of the viscoelasticity on temperature is smaller when the temperature is lower than the melting point.

FIG. 1 is a graph showing the preferable characteristics of the electrophotographic toner according to the present invention. In FIG. 1, the vertical axis shows the common logarithm log $G_L$ for the storage elastic modulus or the common modulus log $G_N$ for the loss elastic modulus, while the horizontal axis shows the temperature. In the electrophotographic toner having the characteristics as shown in FIG. 1 according to the present invention, the elastic modulus rapidly drops for the melting point in the temperature range from 60 to 120° C., and stabilizes within a certain temperature range, so that heterogeneity of image gloss generated due to heterogeneous temperature distribution in fixing over an image in excessive permeation of the toner into a recording medium such as paper can be prevented even when the temperature is high.

Because the electrophotographic toner according to the present invention has the characteristics as described above, the toner is excellent in its capability of preventing toner blocking, which ensures the superior storability of images developed with the toner as well as superior adaptability to low temperature fixing.

<Method of Manufacturing the Electrophotographic Toner>

The electrophotographic toner manufacturing method according to the present invention is a wet particle manufacturing method in which at least a binding resin dispersion liquid and a colorant particle dispersion liquid are mixed and a coagulant is added to the mixture to grow particles. A preferable example of this wet particle manufacturing method is the emulsion polymerization/aggregation method described below. For example, a crystalline polyester resin may be used as a crystalline resin in this emulsion polymerization/aggregation method.

The emulsion polymerization/aggregation method comprises an emulsifying step of emulsifying the crystalline polyester resin described in the <Binding resin> section above in the electrophotographic toner according to the present invention to form emulsified particles, an aggregating step of forming aggregation of the emulsified particles (droplets), and a coalescing step of thermally coalescing the aggregation by melting the aggregation at a temperature higher than the melting point of the crystalline polyester resin. The method may comprise an associating step in which aggregation and coalescing are simultaneously performed at a temperature higher than the melting point of the crystalline polyester resin in place of the aggregating step and the coalescing step.

In the emulsifying step, emulsified particles (droplet) of the polyester resin is formed by loading a shearing force to a mixture solution (polymer liquid) containing an aqueous solvent, sulfonated polyester resin, and a colorant, if necessary.

In this step, the emulsified particles can be formed by lowering viscosity of the polymer liquid by heating it to a temperature higher than the melting point of the crystalline polyester resin. A dispersant may also be used to stabilize the emulsified particles or to raise viscosity of the aqueous solvent. The dispersion liquid of the emulsified particles is sometimes described as "resin particle dispersion liquid" hereinafter.

The materials which may be used as the dispersant described above include, but are not limited to, water-soluble high molecules such as polyvinyl alcohol, methyl cellulose, carboxymethyl cellulose, and polyacrylic acid sodium salt; anionic surfactants such as sodium dodecylbenzenesulfonate, sodium octadecylsulfate, sodium oleate, sodium laurate, and potassium stearate; cationic surfactants such as lauryl amine acetate, and lauryl trimethyl ammonium chloride; amphoteric surfactants such as lauryl dimethyl amine oxide; nonionic surfactants such as polyoxyethylene alkyl ether, polyoxyethylene alkylphenyl ether, and polyoxyethylene alkyl amine; and inorganic compounds such as tricalcium phosphate, aluminum hydroxide, calcium sulfate, calcium carbonate, and barium carbonate.

The dispersant content in 100 weight portions of polyester resin should preferably in the range from 0.01 to 20 weight percent.

In the emulsifying step, by copolymerizing a dicarboxylic acid having a sulfonic acid group with the polyester resin (so that an appropriate quantity of component derived from the dicarboxylic acid having a sulfonic acid group will be contained in the acid-derived component), it is possible to reduce a quantity of the dispersant/stabilizer such a surfactant to be used in the present invention, or to form emulsified particles even without using the dispersant/stabilizer.

Any of, for example, a homogenizer, a homomixer, a pressurizing kneader, an extruder, and a media dispersing unit may be used as an emulsifying unit to be used for forming the emulsified particles. The average volume size of the emulsified particles (droplet) of the polyester resin should preferably be in the range from 0.005 to 1 $\mu$m, and more preferably in the range from 0.01 to 0.4 $\mu$m. When the size is less than 0.005 $\mu$m, substantially all of the particles are dissolved in water, which makes it difficult to prepare particles, while, when the size is more than 1 $\mu$m, it is impossible to obtain particles with the desired size in the range from 3.0 to 7.5 $\mu$m.

Any of the known means such as a rotating/shearing type of homogenizer, a ball mill having a medium, a sand mill, and a dynomill may be used to disperse the colorant.

An aqueous dispersant liquid of these colorant may be prepared by using a surfactant, if necessary or desired. The colorant dispersion liquid may sometimes be described as "colorant particle dispersion liquid" hereinafter. As the surfactant or dispersant used for dispersion of the colorant particles, the same dispersant as that used for dispersing the polyester resin may be used.

A colorant may also be mixed in the resin before formation of the emulsified particles. Melting dispersion with a disperser or the like may be employed for mixing the colorant in the resin.

In the aggregating step, the obtained emulsified particles are heated to a temperature close to but below the melting point of the polyester resin for melting and aggregating the particles to form aggregation thereof. Aggregation of emulsified particles is performed by the acidifying pH of the emulsion and agitation. The pH should preferably be in the range from 2 to 6, and more preferably in the range from 2.5 to 5. In the step, a coagulant may also advantageously be used.

As the coagulant to be used in this step, any of the surfactants having a polarity reverse to that used in the dispersant, inorganic metal salts such as sodium chloride, magnesium carbonate, magnesium chloride, magnesium nitrate, magnesium sulfate, calcium chloride, and aluminum sulfate, and bivalent or higher metal complexes may advantageously be used.

In the coalescing step, aggregation is stopped by controlling the pH of a suspension of the aggregation within a range from 3 to 7 agitating in the same manner as that in the aggregating step, and the aggregation is heated to a temperature equal to or higher than the melting point of the crystalline polyester resin for melting and coalescing the aggregation. The temperature to which the aggregation is heated should be not less than the melting point of the crystalline polyester resin. The heating should be continued so that the aggregation is sufficiently coalesced, namely in the period from about 0.2 to about 10 hours. Then, the aggregation is cooled down to the temperature equal to or lower than the crystallizing point of the crystalline polyester resin for solidifying the particles, when forms and surface characteristics of the particles change according to the cooling rate. For example, when cooled at a high rate, the particles are apt to become spherical shaped and smooth surfaced. On the other hand, when they are slowly cooled, the particles tend to have heterogeneous forms with irregular surfaces. As such, the aggregation should preferably be cooled at the rate of 1° C. per minute or more, and preferably at the rate of 3° C. per minute or more, to a temperature equal to or less than the crystallizing temperature of the crystalline polyester resin. By cooling the binding resin for crystallization at the cooling rate of 1° C. per minute or more, particles having a BET specific surface area in the range from 2 to 5 and a shape factor SF1 in a range from 110 to 140 can be manufactured.

In the associating step in which aggregation and coalescing are performed simultaneously, the polyester resin is heated to and maintained at a temperature higher than the melting point thereof by controlling the pH in the same manner as that in the aggregating step or by adding a coagulant to grow the particles, and when a desired particle size is achieved, the crystalline polyester resin is cooled to the crystallizing temperature thereof at a rate of at least 1° C. per minute as in the coalescing step to stop growth of the particle size simultaneously when crystallization is started. Adjustment of the pH may be performed either before or after cooling. The process is advantageously simplified in the associating step as described above because aggregation and coalescing can be performed simultaneously. Further, by cooling the polyester resin at the rate of 1° C. per minute or more when particle size growth is stopped as in the associating step, the particles become spherical and smooth surfaced, and particles having a BET specific surface area in the range from 2 to 5 and a shape factor SF1 in the range from 110 to 140 can be manufactured.

The particles prepared by melting can be processed into toner particles by subjecting the particles obtained as described above to processes such as solid phase/liquid phase separation, cleaning, and drying, if necessary. When this is done, to ensure superior adaptability to being electrically charged and the reliability, sufficient cleaning should preferably be performed in the cleaning step.

For drying, any of known methods such as the ordinary vibration type of flow drying method, spray drying method, freeze drying method, and flush jet method may be employed. The toner particles should have a moisture content, after drying, of 1.5% or less, and more preferably 1.0% or less.

In the coalescing step or in the associating step, a bridging reaction may be formed when the crystalline polyester resin is being heated to a temperature higher the melting point, or after the coalescing step is finished. When the bridging reaction is performed, an unsaturated sulfonated crystalline polyester resin with a double-bonding component copolymerized therewith my be used as a binding resin, for example, and the resin may be caused to undergo a radical reaction by using a polymerization initiator such as t-butylperoxy-2-ethylhexanoate to introduce a bridged structure therein.

The polymerization initiator may be mixed in a polymer before start of the emulsifying step, or may be mixed in an aggregated block in the aggregating step. Further, the polymerization initiator may be introduced into the reaction system during or after the coalescing or associating step. When this is done, a liquid prepared by dissolving the polymerization initiator in an organic solvent may be added to the particle dispersion liquid (resin particle dispersion liquid or the like). Any of known bridging agents, chain transfer agents, and polymerization inhibitors may also be added to the polymerization initiator.

With the method of manufacturing the electrophotographic toner according to the present invention, a shape and surface smoothness of the toner particles can be controlled. The toner particles should preferably have a form close to a spherical form, and the surface should preferably be smooth. When the particles are spherical and have a smooth surface, the non-electrostatic adherence decreases, so that the adaptability to being transferred is improved with externally added agents hardly buried therein, and as a result the transfer efficiency and fluidity of the toner powder are improved. The adaptability to being electrically charged is also improved and the charge is maintained for a longer period.

Additives such as a fluidizer or an adjuvant may be added to the toner according to the present invention to process surfaces of the toner particles. As example additives, any known type of fine particle additive including inorganic particles such as those of silica with the hydrophobic surface, titanium oxide, alumina, cerium oxide and carbon black and fine particles of polymers such as polycarbonate, polymethyl methacrylate, and silicone resin may be used. It is, however, preferable to use at least two or more of these additives, and at least one of these additives should preferably have and average primary particle size from 30 nm to 200 nm, and more preferably between 30 nm and 180 nm. When the toner particle size is small, non-electrostatic adherence to a photoreceptor increases, which causes a transfer fault or a printing fault such as hollow character, and it in turn causes transfer irregularities in overprinted images or the like, so that it is preferable to improve the adaptability of the toner to transfer by adding an outer additive having a large average primary particle size in the range from 30 nm to 200 nm. When the average primary particle size is less than 30 nm, fluidity of the toner is preferable in the initial stage, but the non-electrostatic adherence between the toner and a photoreceptor cannot be completely lowered, which causes degradation of the transfer efficiency, a printing fault such as hollow character, and heterogeneity of an image developed with the toner, and, further, the fine particles become buried in surfaces of the toner particles due to stress in the developing unit in association with passage of time and the adaptability to being electrically charged is changed, which causes such troubles as lowering of thickness in copied images or brushing over the background section. Additionally, when the average primary particle diameter is larger than 200 nm, the outer additive often gets separated from the toner surface, which in turn degrades the fluidity of toner.

<Electrostatically Charged Image Developer and Carrier>

The developer according to the present invention may be classified as one of a one-component developer comprising a toner and a two-component developer comprising a toner and a carrier. However, the two-component developer, which has superior capability for maintaining electrostatic charge over a long period as well as stability, is preferable. The carrier should preferably be coated with a resin, and more preferably be coated with a nitrogen-containing resin.

The nitrogen-containing resin includes, acrylic resins including for instance, dimethyl aminoethylmethacrylate, dimethylacrylamide, and acrylonitrile; amino resins including urea, urethane, melamine, guanamine, and aniline; amide resins; and urethane resins. Copolymers thereof are also allowable.

Two or more of these nitrogen-containing resins may be used in combination as the resin for coating the carrier. Further, the nitrogen-containing resin may be combined in use with a resin not containing nitrogen. In addition, the nitrogen-containing may be pulverized into fine particles to be dispersed in a resin not containing nitrogen. Especially the urea rein, urethane resin, melamine resin, and amide resin are preferable because the resins are well adapted to being negatively charged and are capable, with the high degree of hardness, of preventing loss of charge due to, for instance, separation of the coating resin.

Generally, a carrier should have an appropriate level of electric resistance, and the electric resistance value should preferably be in the range from about $10^9$ to about $10^{14}$ Ω cm. When the electric resistance value is low, for instance, $10^6$ Ω cm, as is the case with iron powder carrier, the carrier may be deposited on an image-formed section of a photoreceptor or the latent image charge escapes through the carrier when an electric charge is injected from a sleeve, which in turn causes such troubles as disturbance of the latent image or hollow sections in the printed image. On the other hand, which an insulating resin is coated with the large thickness, the electric resistance value becomes too high, and, in such a case, the carrier charge is hardly leaked, which causes the problem of edge effect in which the printed image is sharp in the edge section but is very thin in the central portion when the image is large. To prevent generation of the trouble, it is preferable to disperse conductive fine particles in a resin coat layer for adjusting a resistance value of the carrier.

Examples of acceptable conductive fine particles include metals such as gold, silver, and copper; carbon black; semiconductive oxides such as titanium oxide, and zinc oxide; powders of titanium oxide, zinc oxide, barium sulfate, aluminum borate, potassium titanate or the like with the surface covered with tin oxide, carbon black, or any metal. Of these, carbon black is the most preferable because of its stability in production, low cost, and excellent conductivity.

The resin coat layer may be formed on a surface of a carrier core material, for example, by the dipping method in which powder of the carrier core material is dipped in a solution for forming a coat layer; the spraying method in which the solution for forming a coat layer is sprayed over a surface of the carrier core material; fluidized bed method in which the solution for forming a coat layer is sprayed in the state where the carrier core material is floating in an air flow; the kneader coater method in which a carrier core material and a solution for forming a coat layer are mixed in a kneader coater and a solvent is removed; and the powder coat method in which the resin to be coated is pulverized into fine particles and the fine particles are mixed with the carrier core material at the temperature higher than the melting point of the resin in a kneader coater, and then the mixture is cooled and used for coating. Of these, the kneader coater method and powder coat method are especially preferable.

The average film thickness of the resin coat layer formed by any of the methods described above is typically in the range from 0.1 to 10 $\mu$m and more preferably in the range from 0.2 to 5 $\mu$m.

There is no specific restriction on the carrier core material used in the carrier for developing an electrostatic latent image according to the present invention, and magnetic metals such as iron, steel, nickel, and cobalt, or magnetic oxides such as ferrite or magnetite, or glass bead may, for example, be used for this purpose, and the magnetic carrier is preferable in the magnetism brush method. The average particle size of the carrier core material should generally be in the range from 10 to 100 $\mu$m, and more preferably in the range from 20 to 80 $\mu$m.

The mixing ratio between the electrophotographic toner according to the present invention and the carrier (weight ratio) in the two-component developer should generally be in the range from 1:100 to 30:100, and more preferably in the range from 3:100 to 20:100.

<Image Forming Method>

The image forming method using a developer for electrophotography according to the present invention is described in the following. The image forming method comprises a latent image processing stage in which an electrostatic latent image is formed on a surface of an electrostatic image carrier, a developing stage in which the electrostatic latent image formed on a surface of the electrostatic latent image carrier is developed to form a toner image; a transfer state in which the toner image formed on the electrostatic latent image carrier is transferred onto a surface of a transfer member such as a sheet of paper; and a fixing stage in which the toner image transferred onto a surface of the transfer member is thermoelectrically fixed. This method is characterized in that particles of the electrophotographic toner according to the present invention are used as toner particles to be used in the electrostatically charged image developer. Such materials as, for example, an electrophotographic photoreceptor and a dielectric recording medium may be used as the electrostatic latent image carrier.

In the case of a photoreceptor for electrophotography, a surface of the photoreceptor for electrophotography is homogeneously charged with a device such as a corotron charger, or a contact charger, and is then exposed to a light beam to form an electrostatic latent image (electrostatic latent image processing stage).

The electrostatic latent image formed on the latent image carrier is then developed with a toner comprising coloring particles containing at least a binding resin and a colorant to form a toner image, and in the electrophotography a developer layer is formed on a surface of a developer carrier provided at a position opposite to the latent image carrier, and the electrostatic latent image formed on the surface of the latent image carrier is developed with the developer layer. In the case of a two-component developer comprising a toner and a carrier, a magnetic carrier layer is formed on a surface of the developer carrier with a form like a brush, and the toner is deposited on the magnetic carrier layer to form the development layer, a process which is often referred to as magnetism brush (developing stage).

The toner image formed on the latent image carrier is transferred by such a device as a corotron charger onto a transfer member such as a sheet of paper. The toner image obtained in the developing stage may is transferred, as it is, onto a transfer member, but the configuration is allowable in which the toner image is once transferred once onto another intermediate transfer member and then to the transfer member.

A full color image is obtained by transferring and laminating toners of at least three colors of cyan, magenta, and yellow, or of these three colors plus black, in the developing stage. In this step, using an intermediate transfer member for once transferring and laminating these toner images onto an intermediate transfer member and then transferring the toner images in batch to the transfer member is preferable for obtained an image with clear colors and no positional displacement.

To obtain a monochrome image, the toner weight (TMA) in 100% image area in the image transferred on the transfer member should preferably be not more than 0.80 mg/cm$^2$, and more preferably not more than 0.60 mg/cm$^2$ (transfer stage).

The toner image transferred onto a surface of the transfer member is thermally fixed by a heating type fixing unit to form a final toner image. The heating type fixing unit may be based either on a contact heating type of fixing system using a heating roller or the like, or on a non-contact heating type of fixing system employing heating in an oven, but the contact type of fixing unit is preferable from the view points of reliability, safety, and heat efficiency. As used herein, the term contact type fixing device refers to one based on a system in which a fixing member such as a fixing roller presses a transfer member on which a transferred image has been formed to fixed the transferred image on the transfer member, and any conventional contact type fixing unit may be used for this purpose. For pressing the transferred image to the transfer member, for example, the transfer member with the transferred image formed thereon may be passed through between two rollers contacting each other, or between a roller and a belt also contacting each other so that a tip area between the rollers or between the roller and the belt pressed the transferred image for pressing (fixing stage).

As the transfer member to which the toner image is transferred (recording member), for example, common paper, or OHP sheet which are used in a copying machine or a printer based on the electrophotographic system may be used.

For further improving smoothness of a surface of the fixed image, a surface of the recording member should preferably be as smooth as possible and, for example, coated paper, which is common paper coated with a resin or the like, and art paper for printing may advantageously be used.

When using the electrophotographic toner according to the present invention, fixing can be performed at a temperature substantially lower than that in the conventional technology, to thereby enable reduction of energy consumed in the fixing step or the warm-up time and ensures excellent storability of the image formed with the toner. Further, because the fluidity and the adaptability to being transferred of the toner are superior, a high quality image can be formed with a stabilized electrified state. In addition, the transfer efficiency is improved, so that a quantity of residual toner decreases with the cost reduced.

EXAMPLES

The present invention is described below with reference to several examples, but it should be noted that the present invention is not limited to the examples. Also it should be noted that the term "portion" used in the following description indicates a weight portion as described above, unless otherwise specified.

Preparation of Crystalline Polyester Resin (1)

124 weight portions of ethylene glycol, 22.2 weight portions of sodium dimethyl 5-sulfoisophthalate, 213 weight portions of dimethyl sebacate, and 0.3 weight portions of dibutyl tin oxide as a catalyst were put in a heated and dried three neck flask, and air in the vessel was replaced with nitrogen by means of depressurizing to create an inert atmosphere, and the mixture was mechanically agitated for 5 hours at 180° C. The temperature was next gradually raised to 220° C. and the mixture was agitated for an additional 2 hours under decompressing conditions until the mixture became gummy, when the reaction was stopped by cooling the mixture to synthesize 220 weight portions of crystalline polyester resin (1).

The weight-average molecular weight ($M_w$) of the obtained crystalline polyester resin (1) obtained by the gel permeation chromatography (GPC) measurement was 9700, while the number-average molecular weight ($M_n$) was 5400.

When the melting point ($T_m$) of the crystalline polyester resin (1) was measured using the measurement method described above and with a differential scanning calorie meter (DSC), a clear peak was shown, and the temperature corresponding to the peak top was 69° C.

A content ratio between the copolymer content (5-sulfoisophtalate component) and a sebacate component measured from the NMR spectrum of the resin was 7.5:92.5.

Preparation of the Resin Particle Dispersion Liquid (1)

150 weight portions of crystalline polyester resin was put in 850 weight portions of distilled water, and the mixture was heated to and maintained at 85° C. and agitated with a homogenizer (ULTRA TRAX, manufactured by IKA Japan Corporation) to obtain the resin particle dispersion liquid.

Preparation of Crystalline Polyester Resin (2)

18.9 weight portions of 1,20-eicosane diol, 1.3 weight portions of sodium dimethyl 5-sulfoisophthalate, 10 weight portions of dimethylsulfoxide, and 0.03 weight portions of dibutyl tin oxide were put in a three neck flask, and air within the vessel was replaced with nitrogen by depressurizing to create an inert atmosphere, and the mixture was mechanically agitated for 3 hours at 180° C. After depressurized, dimethylsulfoxide was removed, and 15.9 weight portions of dimethyl dodecanediolate were added under a nitrogen flow, and the mixture was agitated for 1 hour at 180° C.

The temperature was next gradually raised to 220° C. over 30 minutes with agitation until the mixture became gummy. The mixture was then cooled with air to stop the reaction to synthesize 33 weight portions of crystalline polyester resin (2).

The weight-average molecular weight ($M_w$) of the crystalline polyester resin obtained by GPC measurement (as converted to polystyrene) was 7200, while the number-average molecular weight ($M_n$) was 4100.

The melting point of the crystalline polyester resin (2) was measured with DSC and by the same measurement method as described above, and it was found that a clear peak was shown and the temperature corresponding to the peak top was 93° C.

A content ratio between the copolymer component (5-suofoisophthalate component) and dodecanediolate component was 7.7:92.3.

Preparation of the Resin Particle Dispersion Liquid (2)

150 weight portions of crystalline polyester resin was put in 850 weight portions of distilled water, and the mixture was heated to and maintained at 99° C. and agitated with a homogenizer (manufactured by IKA Japan Corporation; UTLTRA TRAX) to obtain the resin particle dispersion liquid.

Preparation of the Colorant Dispersion Liquid (1)

250 weight portions of cyan pigment (ECB-301 manufactured by Dainichiseika Color & Chemicals Mgf. Co., Ltd.), 20 weight portions of anionic surfactant (NEOGEN RK manufactured by Dai-Ichikogyo Seiyaku Co., Ltd.), and 730 weight portions of ion-exchanged water were mixed and the mixture was dispersed with a homogenizer (ULTRA TRAX, manufactured by IKA Japan Corporation) to prepare a colorant dispersion liquid with the colorant (cyan pigment) dispersed therein.

Preparation of the Colorant Dispersion Liquid (2)

250 weight portions of magenta pigment (ECR-186Y manufactured by Daiichiseika Color & Chemicals Mgf. Co., Ltd.), 20 weight portions of anionic surfactant (NEOGEN RK by Dai-Ichikogyo Seiyaku Co., Ltd.), and 730 weight portions of ion-exchanged water were mixed together, and the mixture was dispersed in the same manner as that employed for making the colorant dispersion liquid (1), and further the colorant (magenta pigment) was mixed in the mixture to prepare the colorant dispersion liquid (2).

Preparation of the Colorant Dispersion Liquid (3)

250 weight portions of yellow pigment (Hansa Brill Yellow 5GX03 manufactured by Clariant Japan K. K.), 20 weight portions of anionic surfactant (NEOGEN RK manufactured by Dai-Ichikogyo Seiyaku Co., Ltd.), and 730 weight portions of ion-exchanged water were mixed, and the mixture was dispersed in the same manner as that employed for making the colorant dispersion liquid (1), and further the colorant (yellow pigment) was mixed in the mixture to prepare the colorant dispersion liquid (3).

Preparation of the Colorant Dispersion Liquid (4)

250 weight portions of carbon black (manufactured by Cabot Corporation: REGAL 330), 20 weight portions of anionic surfactant (Dai-Ichikogyo Seiyaku Co., Ltd.: NEOGEN RK), and 730 weight portions of ion-exchanged water were mixed, and the mixture was dispersed in the same manner as that employed for making the colorant dispersion liquid (1), and further the colorant (carbon black) was mixed in the mixture to prepare the colorant dispersion liquid (4).

Preparation of the Release Agent Dispersion Liquid 350 weight portions of release agent (REKEMAL B-200 manufactured by Reken Vitamin Co., Ltd. and having a melting point of 68° C.), 15 weight portions of anionic surfactant (NEOGEN RK manufactured by Dai-Ichikogyo Seiyaku Co., Ltd.), and 635 weight portions of ion-exchanged water were mixed together, and the mixture was heated to and maintained at 90° C. with agitation in a water bath, and was dispersed with an ULTRA TRAX homogenizer (manufactured by IKA Japan Corporation) to prepare the release agent dispersion liquid.

Preparation of the Electrophotographic Toner (1)

1600 weight portions of resin particle dispersion liquid (1), 52 weight portions of colorant dispersion liquid (1), 66 weight portions of release agent dispersion liquid, 5 weight portions of calcium chloride (manufactured by Wako Pure Chemical Industries, Ltd.), and 100 weight portions of ion-exchanged water were accommodated within a round stainless flask with the pH adjusted to 4.0, and the mixture was dispersed with a homogenizer (ULTRA TRAX, manufactured by IKA Japan Corporation), and was heated to 65° C. in an oil bath for heating with agitation. The mixture was maintained at 65° C. for 3 hours, and then was observed with an optical microscope, whereupon it was found that aggregated particles with the average particle size of about 5.0 μm had been formed. The mixture was maintained at 65° C. for an additional 1 hour with agitation, and then was observed with an optical microscope to find that the aggregated particles with the average particle size of about 5.5 μm had been formed.

The pH of the aggregated particle dispersion liquid was 3.8. 0.5 weight % diluted sodium carbonate aqueous solution (manufactured by Wako Pure Chemical Industries, Ltd.) was gradually added to adjust the pH to 5.0. The aggregated particle dispersion liquid was heated to and maintained at 80° C. for 30 minutes with agitation, and then was observed with an optical microscope to find that coalesced spherical particles had been formed. Then ion-exchanged water was added to the mixture to cool it at the rate of 10° C. per minute to 30° C. to solidify the particles.

Then the reaction product was filtered, fully washed with ion-exchanged water, and dried with a vacuum drier to obtain the colored particles for electrophotography (1).

The obtained colored particles for electrophotography (1) were measured with a particle size analyzing apparatus that uses the Coulter principle, such as the COULTER COUNTER Model TA-II (with the aperture diameter of 50 μm manufactured by Coulter Co., Ltd.) to find that the average volume particle size was 5.5 μm and the average number particle size was 4.6 μm. The particles were observed with an optical microscope to find that the particles were spherical.

The shape factor SF1 of the colored particles measured by observing the particles with the LUZEX image analyzer was 121. The BET specific area of the colored particles was 1.41 $m^2/g$.

0.8 weight % of silica fine particles (hydrophobic silica manufactured by Nippon Aerosol K. K; RX500) having an average primary particle size of 40 nm with the hydrophobic surface and 1.0 weight % of methatitanate compound fine particles with the average primary particle size of 20 nm obtained as a reaction product by adding 40 weight portions of isobutyl methoxysilane and 10 weight portions of trifluoropropyl methoxysilane in 100 weight portions of methatitanic acid were mixed and agitated for 5 minutes with a Henschel mixer, then the electrophotographic toner (1) was obtained by passing through a screen with 45 μm mesh.

Preparation of the Electrophotographic Toner (2)

1600 weight portions of the resin particle dispersion liquid (2), 52 weight portions of colorant dispersion liquid (1), 66 weight portions of release agent dispersion liquid, 5 weight portions of calcium chloride (manufactured by Wako Pure Chemical Industries, Ltd.), and 100 weight portions of ion-exchanged water were put in a round stainless flask with the pH adjusted to 4.0, and the mixture was dispersed with a homogenizer (ULTRA TRAX, manufactured by IKA Japan Corporation) and heated to 88° C. in an oil bath for heating with agitation. The mixture was maintained at 88° C. for 3 hours and then was observed with an optical microscope to find that aggregated particles with an average particle size of about 4.2 μm had been formed. The mixture was maintained under 88° C. additionally for 1 hour and was then observed with an optical microscope to find that aggregated particles with the average particle size of about 5.2 μm had been formed.

The pH of the aggregated particle dispersion liquid was 3.7. 0.5 weight % diluted sodium carbonate aqueous solution (manufactured by Wako Pure Chemical Industries, Ltd.) was gradually added to the mixture to adjust the pH to 5.0. The aggregated particle dispersion liquid was heated to and maintained at 97° C. for 30 minutes with agitation, and was then observed to find that coalesced spherical particles had been formed. Then ion-exchanged water was added to cool the mixture to 30° C. at the rate of 10° C. per minute for solidifying the particles.

Then the reaction product was filtered, fully washed with ion-exchanged water, and dried with a vacuum drier to obtain the colored particles for electrophotography (2).

The obtained colored particles for electrophotography (2) were measured with a particle size analyzing apparatus that uses the Coulter principle, such as a COULTER COUNTER Model TA-II manufactured by Coulter Co., Ltd. and having an aperture size of 50 μm, to find that the average volume particle size was 5.9 μm and the average number particle size was 5.0 μm. The particles were observed with an optical microscope to find that the particles were spherical.

The shape factor SF1 of the colored particles measured by observing the particles with the LUZEX device was 123. The BET specific area of the colored particles was 1.38 $m^2/g$.

An outer additive was mixed in the obtained colored particles for electrophotography (2) and the mixture was agitated in the same manner as that for preparation of the electrophotographic toner (1) to obtain the electrophotographic toner (2).

Preparation of the Electrophotographic Toner (3)

1600 weight portions of the resin particle dispersion liquid (1), 52 weight portions of the colorant dispersion liquid (1), and 66 weight portions of release agent dispersion liquid were put in a round stainless flask, and the mixture was dispersed with an ULTRA TRAX homogenizer manufactured by IKA Japan Corporation, and was heated to 80° C. in an oil bath for heating and agitation. An aqueous solution prepared by dissolving 5 weight portions of calcium chloride (manufactured by Wako Pure Chemical Industries, Ltd.) in 100 weight portions of ion-exchanged water was added to the mixture over 3 hours, and the resultant mixture was observed with an optical microscope whereupon it was found that particles with an average particle size of about 5.6 μm had been formed. Then ion-exchanged water was added to cool it at the rate of 10° C. per minute to 30° C. for solidifying the particles.

After the particles were cooled, 0.5 weight portion diluted sodium carbonate aqueous solution (manufactured by Wako Pure Chemical Industries, Ltd.) was gradually added to the mixture to adjust the pH to 5.0.

The reaction product was filtered, fully washed with ion-exchanged water, and dried with a vacuum drier to obtain the colored particles for electrophotography (3).

The obtained colored particles for electrophotography (3) were measured with a particle size analyzing apparatus that uses the Coulter principle, such as a Coulter Co., Ltd. COULTER COUNTER Model TA-II with an aperture size of 50 μm to find that the average volume particle size was 5.8 μm and the average number particle size was 5.2 μm. The particles were observed with an optical microscope to find that the particles were spherical.

The shape factor SF1 of the colored particles measured by observing the particles with the LUZEX device was 120. The BET specific area of the colored particles was 1.31 $m^2/g$.

An outer additive was mixed in the obtained colored particles for electrophotography (3) and the mixture was agitated in the same manner as that for preparation of the electrophotographic toner (1) to obtain the electrophotographic toner (3).

Preparation of the Electrophotographic Toner (4)

The colored particles for electrophotography (4) were created in the same manner as that employed for preparing the colored particles for electrophotography (1) except the point that cooling was performed at the range of 3° C. per minute.

The obtained colored particles for electrophotography (4) were measured with a particle size analyzing apparatus that uses the Coulter principle, such as a COULTER COUNTER Model TA-II with an aperture size of 50 μm to find that the average volume particle size was 5.7 μm and the average number particle size was 4.7 μm. When the particles were observed with an optical microscope it was noted that the particles were spherical.

The shape factor SF1 of the colored particles measured by observing the particles with the LUZEX device was 126. The BET specific area of the colored particles was 1.68 $m^2/g$.

An outer additive was mixed in the obtained colored particles for electrophotography (4) and the mixture was agitated in the same manner as that for preparation of the electrophotographic toner (1) to obtain the electrophotographic toner (4).

Preparation of the Electrophotographic Toner (5)

The colored particles for electrophotography (5) were prepared in the same manner as that employed for preparation of the colored particles for electrophotography (1) with the exception that 92 weight portions of the colorant dispersion liquid (2) was used in place of 52 weight portion of the colorant dispersion liquid (1).

The obtained colored particles for electrophotography (5) were measured with a particle size analyzing apparatus that uses the Coulter principle, such as a COULTER COUNTER Model TA-II with an aperture size of 50 μm and it was found that the average volume particle size was 5.6 μm and the average number particle size was 4.7 μm. When particles were observed with an optical microscope it was found that the particles were spherical.

The shape factor SF1 of the colored particles measured by observing the particles with the LUZEX device was 122. The BET specific area of the colored particles was 1.48 $m^2/g$.

An outer additive was mixed in the obtained colored particles for electrophotography (5) and the mixture was agitated in the same manner as that for preparation of the electrophotographic toner (1) to obtain the electrophotographic toner (5).

Preparation of the Electrophotographic Toner (6)

The colored particles for electrophotography (6) were prepared in the same manner as that employed for preparation of the colored particles for electrophotography (1) with the exception that 120 weight portions of the colorant dispersion liquid (3) was used in place of 52 weight portion of the colorant dispersion liquid (1).

The obtained colored particles for electrophotography (6) were measured with a particle size analyzing apparatus that uses the Coulter principle, such as a COULTER COUNTER Model TA-II with an aperture size of 50 μm manufactured to find that the average volume particle size was 5.9 μm and the average number particle size was 5.0 μm. The particles were observed with an optical microscope to find that the particles were spherical.

The shape factor SF1 of the colored particles measured by observing the particles with the LUZEX device was 120. The BET specific area of the colored particles was 1.39 $m^2/g$.

An outer additive was mixed in the obtained colored particles for electrophotography (6) and the mixture was agitated in the same manner as that for preparation of the electrophotographic toner (1) to obtain the electrophotographic toner (6).

Preparation of the Electrophotographic Toner (7)

The colored particles for electrophotography (7) were prepared in the same manner as that employed for preparation of the colored particles for electrophotography (1) with the exception that the colorant dispersion liquid (4) was used in place of the colorant dispersion liquid (1).

The obtained colored particles for electrophotography (7) were measured with a particle size analyzing apparatus that uses the Coulter principle, such as a COULTER COUNTER Model TA-II with an aperture size of 50 μm and it was found that the average volume particle size was 6.2 μm and the average number particle size was 5.4 μm. When the particles were observed with an optical microscope it was noted that the particles were spherical.

The shape factor SF1 of the colored particles measured by observing the particles with a LUZEX apparatus was 120. The BET specific area of the colored particles was 1.34 $m^2/g$.

An outer additive was mixed in the obtained colored particles for electrophotography (7) and the mixture was agitated in the same manner as that for preparation of the electrophotographic toner (1) to obtain the electrophotographic toner (7).

Preparation of the Electrophotographic Toner (8)

The colored particles for electrophotography (8) were prepared in the same manner as that employed for preparation of the colored particles for electrophotography (1) with the exception that the particles coalesced at 80° C. were cooled at the rate of 0.1° C. per minute to 30° C.

The obtained colored particles for electrophotography (6) were measured with a particle size analyzing apparatus that uses the Coulter principle, such as a COULTER COUNTER Model TA-II (with the aperture size of 50 μm manufactured by Coulter Co., Ltd.) to find that the average volume particle size was 5.9 μm and the average number particle size was 4.9 μm. The particles were then observed with an optical microscope and it was found that the particles were spherical.

The shape factor SF1 of the colored particles measured by observing the particles with a LUZEX device was 127. The BET specific area of the colored particles was 4.26 $m^2/g$.

An outer additive was mixed in the obtained colored particles for electrophotography (8) and the mixture was agitated in the same manner as that for preparation of the electrophotographic toner (1) to obtain the electrophotographic toner (8).

Preparation of the Electrophotographic Toner (9) (Preparation of Particles by means of the conventional type of freeze-fracture)

The crystalline polyester resin (1), cyan pigment (ECB-301 manufactured by Dainihon Seika K. K.), release agent (REKEMAR B-200 manufactured by Riken Vitamin K. K with the melting point of 68° C.) were mixed together and melted at 80° C. with a disperser. The obtained mixture resin was frozen with liquid phase nitrogen, and further was fractured with a jet pulverizer. The pulverized material was classified with a wind force classifier to obtain the colored particles for electrophotography (9).

The obtained colored particles for electrophotography (9) were measured with a particle size analyzing apparatus that uses the Coulter principle, such as a COULTER COUNTER Model TA-II with an aperture size of 50 μm manufactured to find that the average volume particle size was 5.4 μm and the average number particle size was 3.0 μm. The particles were then observed with an optical microscope and it was found that the particles were spherical.

The shape factor SF1 of the colored particles measured by observing the particles with the LUZEX device was 150. The BET specific area of the colored particles was 3.12 $m^2/g$.

An outer additive was mixed in the obtained colored particles for electrophotography (9), and the mixture was agitated in the same manner as that employed for preparation of the electrophotographic toner (1) to obtain the electrophotographic toner (9).

SYNTHESIS of the non-crystalline polyester resin (1)

3.5 molar portions of polyoxyethylene (2,0)-2,2-bis (4-hydroxyphenyl) propane, 65 molar portions of polyoxypropylene (2,2)-2,2-bis(4-hydroxypenyl) propane, 80 molar portions of telephthalic acid, 10 molar portions of n-dodecenylsuccinic acid, 10 molar portions of trimellitic acid, and 0.05 molar portions of dibutyl tin oxide against the acid components (telephthalic acid, n-dodecenylsuccinic acid, and trimellitic acid) were put in a heated and dry two neck flask. Then nitrogen gas was introduced into the vessel to provide an inert atmosphere, and the mixture was heated to and maintained under a temperature range from 150 to 230° C. for about 12 hours for copolycondensation, and then the vessel was gradually depressurized under a temperature from 210 to 250° C. to synthesize the non-crystalline polyester resin (1).

The molecular weight (as converted to polystyrene) was measured by GPC to find that the obtained non-crystalline polyester resin (1) had the weight-average molecular weight ($M_w$) of 10200 and the number-average molecular weight ($M_n$) of 5400.

The DSC spectrum of the non-crystalline polyester resin (1) was measured in the same manner as that used to measure the melting point. A clear peak was not shown, and a step-like change in the endothermal rate was observed. The glass transition temperature ($T_g$) determined as the starting point of the step-like change of endothermal rate was 62° C.

Preparation of the Electrophotographic Toner (10) (Dissoluble Suspension)

82 weight portions of the obtained non-crystalline polyester resin (1) and 18 weight portions of cyan pigment (C.I. pigment blue 15:3) were kneaded and mixed using a Banbury mixer type kneader to obtain an extremely condensed colored resin composition. 25 weight portions of the colored resin composition and 75 weight portions of the non-crystalline polyester resin (1) were dispersed and dissolved in 100 weight portions of ethyl acetate to prepare a dispersion liquid.

The resultant dispersion liquid was added to a mixture solution comprising 1 weight portion of carboxymethyl cellulose, 20 weight portions of potassium carbonate, and 100 weight portions of water, and the mixture was agitated at a high speed to obtain an emulsion. This emulsion was poured into a beaker with a quintuple quantity of water added therein, and the mixture was maintained under 43° C. with agitation for 10 hours to evaporate the ethyl acetate. The potassium carbonate was melted with hydrochloric acid, and was repeatedly washed to obtain a mixture of water and a toner. Finally, the water was evaporated with a freeze-drier to obtain the colored particles for electrophotography (10).

The obtained colored particles for electrophotography (10) were measured with a particle size analyzing apparatus that uses the Coulter principle, such as a COULTER COUNTER Model TA-II having an aperture size of 50 μm and it was found that the average volume particle size was 5.5 μm and that the average number particle size was 4.0 μm. The particles were then observed with an optical microscope and it was noted that the particles were spherical.

The shape factor SF1 of the colored particles measured by observing the particles with the LUZEX device was 126. The BET specific area of the colored particles was 1.87 $m^2/g$.

An outer additive was added to the obtained colored particles for electrophotography (10) in the same manner as that for preparation of the electrophotographic toner (1) to obtain the electrophotographic toner (10).

Preparation of the Carrier 0.12 weight portions of carbon black (VXC-72 manufactured by Cabot Inc.) was mixed in 1.25 weight portions of toluene, and a coating resin solution prepared by mixing 1.25 weight portions of trifunctional isocyanate 80 weight % ethyl acetate solution (TAKENATE D110N manufactured by Takeda Chemical Industries, Ltd.) in the carbon dispersion liquid agitated and dispersed with a sand mill for 20 minutes and kneading the mixture and Mn-Mg-Sr ferrite particles having an average particle size of 35 μm were poured into a kneader, and the mixture was mixed and agitated for 5 minutes at room temperature, and then was heated to 150° C. under the atmospheric pressure to remove the solvent. Further the mixture was agitated additionally for 30 minutes, and then power to the heater was turned OFF to cool the mixture to 50° C. The obtained coat carrier was riddled with a 75 μm mesh to prepare the carrier.

Example 1

Measurement and Assessment of Adaptability of the Powder to Being Aggregated (Capability of Preventing Toner Blocking)

Using a powder tester manufactured by Hosokawa Micron Corporation in conjunction with three screens having meshes of 53 μm, 45 μm, and 38 μm, 2 grams of electrophotographic toner (1) was injected on the top screen with 53 μm mesh with the top screen vibrated with the amplitude of 1 mm for 90 seconds, and after vibration, weights of toner on the three screens were added by weighing the values by 0.5, 0.3 and 0.1 respectively to calculate the percentages. The sample (electrophotographic toner (1)) was left for about 24 hours under environmental conditions of 45° C. and 50% RH, and the measurement was performed under the environmental conditions of 25° C. and 50% RH. The results are shown in Table 1. It should be noted that, in the present invention, if the toner weight portion after the vibration is less than 40, the adaptability of the power to being aggregated is acceptable for actual use, but the weight portion should preferably be less than 30, and more preferably less than 20.

Preparation of the Developer for Electrophotography (1)

5 weight portions of the electrophotographic toner (1) and 95 portions of the carrier were placed in a V blender and the mixture was agitated for 20 minutes and screened with a 105 μm mesh screen to prepare the electrophotographic toner (1).

Assessment of the Adaptability to Transfer

The obtained electrophotographic toner (1) was placed in a DOCUCOLOR 1250 device manufactured by Fuji Xerox Co., Ltd., under the environmental conditions of 25° C. and 50% RH, images not fixed were sampled under the conditions noted below, and the transfer efficiency was measured. 10,000 copies of images were prepared under the environmental conditions of 25° C. and 50% RH, and the transfer efficiency was measured in the same manner. Solid images were used for measuring the transfer efficiency, and were calculated through the following equation. The results are shown in Table 1.

Transfer efficiency (%)=Quantity of toner on paper/(quantity of toner on sheet+quantity of residual toner on photoreceptor)

[Conditions for Forming Images]

(a) Toner image: Solid image (40 mm×50 mm)

Quantity of toner (on recording paper): 0.40 mg/cm$^2$

Recording paper: Paper for color copying manufactured by Fuji Xerox Co., Ltd.

Assessment of the Image Quality

Quality of fixed solid images after 10,000 copies were printed was visually assessed according to the following criteria for assessment. The results are shown in Table 1.

[Criteria for Assessment]

O: No heterogeneous transfer, and no problem

Δ: Slightly heterogeneous transfer observed, but no problem in actual use x: Substantially heterogeneous observed, and not suitable for actual use Assessment of Low-Temperature Fixability A Fuji Xerox DOCUPRINT C2220 fixing apparatus was adjusted to make fixing temperatures variable, and the fixability at low temperatures of the electrophotographic toner (1) was assessed using the above-described images which were not fixed. Specifically, after a fixed image was created using the fixing apparatus set at a preset temperature, the image surface of each fixed image was valley-folded to observe the degree of peeling at the crease portion of the image. The lowest fixing temperature (MFT (° C.)) at which the image barely peeled off was then measured for assessment of the low-temperature fixability. The results are shown in Table 1.

Assessment of Image Storability

Two recording sheets each having a fixed image formed at the lowest fixing temperature (MFT (° C.)) were put together on their image surfaces, and were left for seven days under conditions of 60° C. and 85% of moisture, under a load of 100 g/cm$^2$. Then, the sheets were removed and separated and the image adhesion between recording sheets and image transfer to the non-image areas for performing assessment were observed and classified according to the following criteria. The results are shown in Table 1.

[Criteria for Image Storability Assessment]

o: No problem

Δ: Slight change observed, but no problem in actual use

X: Substantial change observed, and not suitable for actual use

Example 2

Assessment was performed in the same manner as that in Example 1 with the exception that the electrophotographic toner (1) was replaced with the electrophotographic toner (2). The results are shown in Table 1.

Example 3

Assessment was performed in the same manner as that in Example 1 with the exception that rather than the electrophotographic toner (1) the electrophotographic toner (3) was employed. The results are shown in Table 1.

Example 4

Assessment was performed in the same manner as that in Example 1 with the exception that the electrophotographic toner (1) was replaced with the electrophotograhic toner (4). The results are shown in Table 1.

Example 5

Assessment was performed in the same manner as that in Example 1 with the exception that the electrophotographic toner (1) was replaced with the electrophotographic toner (5). The results are shown in Table 1.

Example 6

Assessment was performed in the same manner as that in Example 1 with the exception that the electrophotographic toner (1) was replaced with the electrophotographic toner (6). The results are shown in Table 2.

Example 7

Assessment was performed in the same manner as that in Example 1 with the exception that the electrophotographic toner (1) was replaced with the electrophotographic toner (7). The results are shown in Table 2.

Comparative Example 1

Assessment was performed in the same manner as that in Example 1 with the exception that the electrophotographic toner (1) was replaced with the electrographic toner (8). The results are shown in Table 2.

Comparative Example 2

Assessment was performed in the same manner as that in Example 1 with the exception that the electrophotographic toner (1) was replaced with the electrophotographic toner (9). The results are shown in Table 2.

TABLE 1

| | Example 1 | Example 2 | Example 3 | Example 4 | Example 5 |
|---|---|---|---|---|---|
| Electrophotographic Toner | E.T. (1) | E.T. (2) | E.T. (3) | E.T. (4) | E.T. (5) |
| Coloring Material | Cyan | Cyan | Cyan | Cyan | Magenta |
| Method of manufacturing resin mother particles | Aggregation/ coalescing | Aggregation/ coalescing | Associating | Aggregation/ coalescing | Aggregation/ coalescing |
| Heating rate (° C./minute) | −10 | −10 | −10 | −3 | −10 |
| Volume particle size/number particle size (μm) | 5.5/4.6 | 5.9/5.0 | 5.8/5.2 | 5.7/4.7 | 5.6/4.7 |
| BET specific surface area of particles ($m^2/g$) | 1.41 | 1.38 | 1.31 | 1.68 | 1.48 |
| Shape factor SF1 | 121 | 123 | 120 | 126 | 122 |
| Powder's adaptability to being aggregated | 15 | 14 | 12 | 17 | 13 |
| Transfer efficiency (%) Initial stage | 99 | 99 | 99 | 98 | 99 |
| Transfer efficiency (%) After 10000 Copies printed | 96 | 96 | 96 | 95 | 95 |
| Assessment of images (after 10000 copies printed | ○ | ○ | ○ | ○ | ○ |
| Lowest fixing temperature MFT (° C.) | 90 | 115 | 90 | 90 | 90 |
| Storability of image | ○ | ○ | ○ | ○ | ○ |

TABLE 2

| | Example 6 | Example 7 | Comparative example 1 | Comparative example 2 | Comparative example 3 |
|---|---|---|---|---|---|
| Electrophotographic Toner | E.T. (6) | E.T. (7) | E.T. (8) | E.T. (9) | E.T. (10) |
| Coloring Material | Yellow | Black | Cyan | Cyan | Cyan |
| Method of manufacturing resin mother particles | Aggregation/ coalescing | Aggregation/ coalescing | Aggregation/ coalescing | Melting, mixing/ freeze fracture | Kneading fracture + dissolving, suspending |
| Heating rate (° C./minute) | −10 | −10 | −0.1 | — | — |
| Volume particle size/number particle size (μm) | 5.9/5.0 | 6.2/5.4 | 5.9/4.9 | 5.4/3.0 | 5.5/4.0 |
| BET specific surface area of particles ($m^2/g$) | 1.39 | 1.34 | 4.26 | 3.12 | 1.87 |
| Shape factor SF1 | 120 | 120 | 127 | 150 | 126 |
| Powder's adaptability to being aggregated | 12 | 10 | 26 | 25 | 20 |
| Transfer efficiency (%) Initial stage | 99 | 99 | 91 | 90 | 97 |
| Transfer efficiency (%) After 10000 Copies printed | 96 | 97 | 82 | 80 | 93 |
| Assessment of images (after 10000 copies printed | ○ | ○ | Δ | Δ | ○ |
| Lowest fixing temperature MFT (° C.) | 90 | 90 | 90 | 90 | 150 |
| Storability of image | ○ | ○ | ○ | ○ | X |

Comparative Example 3

Assessment was performed in the same manner as that in Example 1 with the exception that rather than 5 weight portions of the electrophotographic toner (1) and 95 weight portions of the carrier, 9 weight portions of the electrophotographic toner (10) and 91 weight portions of the carrier were employed. The results are shown in Table 1. The results are shown in Table 2.

From the results shown in Tables 1 and 2, it can be understood that, although all of the samples tested in Examples 1 to 7 and Comparative Examples 1 to 3 showed, in a powder state, superior adaptability to being aggregated in the measurement and assessment of the powers' adaptability to being aggregated (the capability of preventing toner blocking), as the sample tested in Example 1 had superior adaptability to being aggregated in comparison with the samples tested in Comparative Examples 1 and 2, the powder's adaptability to being aggregated was improved by processing surface of the particles to obtain spherical particles with smooth surface (with the smaller BET specific surface area and smaller shape factor).

In the assessment of the transfer efficiency, the samples with the smaller BET specific surface area and smaller shape factor tested in Example 1 to 7 and Comparative Example 3 showed a high transfer efficiency even after 10,000 copies of an image were prepared. In contrast, because the sample tested in Comparative Example 1 has a large BET specific surface area with irregular surface, external additives are easily buried in the surface of the particles, with the result that transfer efficiency substantially dropped after 10,000 copies of an image were prepared. The sample tested in Comparative Example 2 proved unstable with a large BET specific surface area and a larger shape factor, so that the transfer efficiency was low even in the initial stage of printing and substantially dropped after 10,000 copies of an image were printed. When a surface of a printed image was observed with a SEM after 10,000 copies of an image were prepared, it was found that the outer additive was not so much buried in surfaces of the samples tested in Examples 1 to 7 and in Comparative Example 3 and remained there, but that the outer additive was buried in the surface of the sample tested in Comparative Example 1 because the surface irregularities and remains in concave sections but decreased in convex sections of a surface of the sample tested in Comparative Example 2.

The image quality was assessed after 10,000 copies of an image were printed, and the adaptability of the samples to transfer remained constant in all of the samples tested for Examples 1 to 7 and Comparative Example 3, and no unevenness of solid images caused by uneven transfer was observed.

In the assessment of adaptability to being fixed, in contrast to the Comparative Example 3 in which a conventional type of resin is used, as a crystalline polyester resin is used in the samples tested in Examples 1 to 7 and Comparative Examples 1 to 2, so that the adaptability to being fixed at a low temperature has been substantially improved. Also the storability after fixing of images developed with the toners is at an acceptable level and is, in fact, excellent.

Comparison of Examples 1 and 3 reveals that the characteristics of the toner are not impaired by differences between these two processes. Further comparison of Examples 1 with Examples 5 to 7 reveals that the characteristics of the toner are not affected by differences in the colorants used in preparation of the toners.

With the toner according to the present invention, the fixing process can be performed at a temperature substantially lower than that required in the conventional technology, and energy consumption and warm-up time can both be substantially reduced. Further, the toner ensures high fluidity and excellent storability of images developed therewith. The improved adaptability to being transferred enables reduction of the amount of wasted toner, and contributes to improvement of image quality. With the toner manufacturing method according to the present invention, a stable toner can be reliably manufactured.

What is claimed is:

1. An electrophotographic toner comprising toner mother particles consisting essentially of a binding resin and a colorant, wherein said binding resin comprising a crystalline resin having the melting temperature in the range from 50 to 120° C. as a main ingredient, the average volume particle size of the toner mother particles is in the range from 3.0 to 7.5 $\mu$m, and the BET specific surface area of the toner mother particles is in the range from 0.6 to 3.0 $m^2/g$.

2. The electrophotographic toner according to claim 1, wherein said crystalline resin is a crystalline polyester resin.

3. The electrophotographic toner according to claim 1, wherein said crystalline polyester resin is an aliphatic crystalline polyester resin.

4. The electrophotographic toner according to claim 3, wherein said crystalline polyester resin comprises a dicarboxylic acid having a sulfonic acid group or a diol as a copolymer component.

5. The electrophotographic toner according to claim 1, wherein said crystalline polyester resin contains a polyester resin comprising an acid-derived component and an alcohol-derived component.

6. The electrophotographic toner according to claim 5, wherein said acid-derived component comprises a component derived from aliphatic dicarboxylic acid.

7. The electrophotographic toner according to claim 6, wherein said acid-derived component comprises one or both of a component derived from dicarboxylic acid having a double bond and a component derived from dicarboxylic acid having a sulfonic acid.

8. The electrophotographic toner according to claim 5, wherein said alcohol-derived component comprises a component derived from aliphatic carboxylic acid.

9. The electrophotographic toner according to claim 8, wherein said alcohol-derived component comprises one or both of a component derived from a diol having a double bond and a component derived from a diol having a sulfonic group.

10. The electrophotographic toner according to claim 1, wherein an average value of the shape factors SF1 of electrophotographic toner particles is in the range from 110 to 140.

11. An electrostatically charged image developer comprising toner particles and a carrier, wherein said toner particles is the electrophotographic toner according to claim 1.

12. An image forming method comprising the steps of:

developing an electrostatic latent image formed on an electrostatic latent image carrier with an electrostatically charged image developer containing the electrophotographic toner according to claim 1 to form a toner image;

transferring the toner image formed on said electrostatic latent image carrier onto a transfer member to form a transfer image; and fixing the transfer image transferred on the transfer member.

13. The electrophotographic toner according to claim 1, wherein said electrophotographic is a full color toner for electrophotography capable of forming a toner image comprising at least the three colors of cyan, magenta, and yellow.

14. The electrophotographic toner according to claim 1, wherein said electrophotographic toner contains 0.5 to 40 weight portions of a release agent.

* * * * *